US010919062B2

(12) United States Patent
Schroer et al.

(10) Patent No.: US 10,919,062 B2
(45) Date of Patent: Feb. 16, 2021

(54) HINGED ELBOW FOR DISPENSING STRAW

(71) Applicant: DDP SPECIALTY ELECTRONIC MATERIALS US, LLC, Wilmington, DE (US)

(72) Inventors: Daniel R. Schroer, Saginaw, MI (US); Marc S. Black, Midland, MI (US); Chad V. Schuette, Freeland, MI (US); Christopher J. Siler, Hemlock, MI (US)

(73) Assignee: DDP SPECIALTY ELECTRONIC MATERIALS US, LLC, Wilmington, DE (US)

( * ) Notice: Subject to any disclaimer, the term of this patent is extended or adjusted under 35 U.S.C. 154(b) by 0 days.

(21) Appl. No.: 15/758,737

(22) PCT Filed: Oct. 19, 2016

(86) PCT No.: PCT/US2016/057625
§ 371 (c)(1),
(2) Date: Mar. 9, 2018

(87) PCT Pub. No.: WO2017/074755
PCT Pub. Date: May 4, 2017

(65) Prior Publication Data

US 2019/0030555 A1 Jan. 31, 2019

Related U.S. Application Data

(60) Provisional application No. 62/246,759, filed on Oct. 27, 2015.

(51) Int. Cl.
*B05B 11/00* (2006.01)
*B05B 15/652* (2018.01)
*B65D 83/30* (2006.01)

(52) U.S. Cl.
CPC ..... *B05B 11/0091* (2013.01); *B05B 15/652* (2018.02); *B65D 83/303* (2013.01)

(58) Field of Classification Search
CPC .. B05B 11/0091; B05B 15/652; B65D 83/303
(Continued)

(56) References Cited

U.S. PATENT DOCUMENTS 4,195,692 A * 4/1980 Dion-Biro ..... A62C 31/05 169/25
4,305,528 A * 12/1981 Craig ..... B65D 83/40 222/182
5,160,071 A * 11/1992 Wright ..... B05B 11/3045 222/324

(Continued)

FOREIGN PATENT DOCUMENTS

EP 1214984 6/2002
GB 2333475 7/1999

(Continued)

*Primary Examiner* — Donnell A Long

(57) ABSTRACT

An article contains an elbow having at least two sections that arc hingcdly attached to one another by means of a hinging joint so that the first section can move in a plane with respect to the second section, wherein the sections define a passageway through which a dispensing straw can extend where the passageway extends all the way through the two sections and perpendicularly through the hinging joint attaching them. The article can include a bendable dispensing straw extending through the passageway of the elbow.

9 Claims, 3 Drawing Sheets

(58) Field of Classification Search
USPC ..... 222/527
See application file for complete search history.

(56) References Cited

U.S. PATENT DOCUMENTS 5,421,519 A * 6/1995 Woods ..... B05B 1/1654 222/402.17
5,480,095 A * 1/1996 Stevenson ..... B05B 11/0005 239/104
8,967,434 B2 3/2015 Lewandowski et al.
9,314,804 B1 * 4/2016 Harrower ..... B05B 1/28
9,676,007 B1 * 6/2017 Kane ..... B08B 3/026
2002/0017575 A1 * 2/2002 Andrews ..... B05B 1/14 239/337
2002/0053579 A1 * 5/2002 Baumgart ..... B65D 83/206 222/527
2004/0044303 A1 * 3/2004 Katz ..... B05B 11/0091 604/19
2008/0099516 A1 * 5/2008 LaCoste ..... A01M 1/245 222/527
2009/0039114 A1 2/2009 Yamamoto et al.
2010/0219261 A1 * 9/2010 Stern ..... B05B 1/02 239/8
2011/0132935 A1 * 6/2011 Greer, Jr. ..... B05B 1/02 222/402.1
2012/0018460 A1 * 1/2012 Slack ..... B65D 1/12 222/534

FOREIGN PATENT DOCUMENTS

GB 2470207 11/2010
JP 2009249026 10/2009
WO 200009438 2/2000

* cited by examiner

HINGED ELBOW FOR DISPENSING STRAW

BACKGROUND OF THE INVENTION

Field of the Invention

The present invention relates to an elbow useful in directing a dispensing straw to a desired angle.

Introduction

A challenge with dispensing materials such as sealant foam from a container is being able to direct the materials into corners, difficult to reach locations and around objects. Typically, one-component spray foam sealants come with a plastic dispensing straw that attaches to the can of spray foam material. A user is limited in dispensing material from the can to wherever the dispensing straw points or where the user utilizes a second hand to direct the dispensing straw to dispense material. It is desirable to have a dispensing straw that is capable of being positioned in angles and directions at will by a user and that will remain in the position chosen by the user while dispensing material through the dispensing straw from a compressed container to eliminate the need to have a user's hand near the point of dispensing.

WO200/09438 discloses a dispensing straw that integrates within the straw a wire "shaping element" along the full length of the straw. The dispensing straw can be bent into a desirable shape or orientation and the wire shaping element serves to hold the dispensing straw in that shape or orientation.

GB2470207 discloses a corrugated tube through which caulk can be dispensed. The corrugated section tube can be bent to a desired angle to dispose caulk in a desired direction other than straight out of a tube of caulk.

It is desirable to have a dispensing straw that will remain in a desired position while dispensing pressurized contents from a container through the straw without requiring an integrally incorporated wire or other shaping element integral to and running along the full length of the dispensing straw or requiring corrugations in the straw

BRIEF SUMMARY OF THE INVENTION

The present invention provides a solution to providing a dispensing straw that will remain in a desired position while dispensing pressurized contents from a container through the dispensing straw without requiring an integrally incorporated wire or other shaping element integral to and running along the length of the dispensing straw or requiring corrugations in the straw.

In one aspect, the present invention is an article comprising an elbow comprising at least two sections that are hingedly attached to one another by means of a hinging joint so that the first section can move in a plane with respect to the second section, wherein the sections define a passageway through which a dispensing straw can extend where the passageway extends all the way through the two sections and perpendicularly through the hinging joint attaching them. The article can further comprise a bendable dispensing straw extending through the passageway of the elbow.

The present invention is useful for directing the dispensing of pressurized contents from a container into desirable locations.

DETAILED DESCRIPTION OF THE INVENTION

Figure 1A:
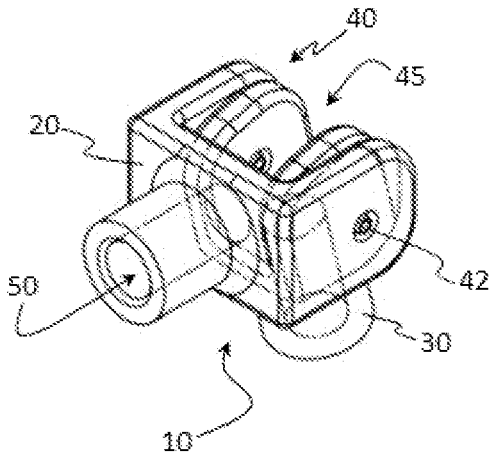
FIG. 1 illustrates one example of an elbow article of the present invention that fully encloses the passageway through most of each section.

"And/or" means "and, or alternatively". All ranges include endpoints unless otherwise stated.

The present invention comprises an elbow that is useful for holding a dispensing straw at a desired angle while dispensing material through the dispensing straw.

The elbow comprises at least two sections that are hingedly attached to one another so that the first section can move in a plane with respect to the second section. Typically, the first section is restricted to only be able to move in a plane with respect to the second section. The composition of the sections comprising the elbow is desirably more rigid than the straw that the elbow is to hold at a desired angle. The elbow is deemed to be more rigid than the straw if the elbow is capable of holding the straw at an angle of 45 degrees or more. The sections can be the same or different in composition. The sections, for example, may be made of any one or combination or more than one of the following materials: plastic, metal, and inorganic mineral. Examples of suitable plastics include polyethylene, polypropylene, polystyrene, polyethylene terephthalate, polyvinyl chloride, polycarbonate, polyurethane, nylon and copolymers of any of these materials. Examples of suitable metals include aluminum, steel, brass, copper, tin, iron and magnesium. Examples of suitable inorganic minerals include ceramic materials.

The sections are 'hingedly" attached if they are capable of moving in a plane, preferably only in a plane, perpendicular to a hinging joint with respect to one another, similar to a door with respect to a wall to which it is mounted using a hinge. The sections can be hingedly attached, for example, by means of pins or other protrusions extending through or from the first section through holes or into indents on the second section to form a hinging joint.

The elbow can consist of just two sections or can comprise more than two sections. For example, the elbow can comprise three or more sections where each are hingedly attached to an adjacent section. When the elbow consists of two sections hingedly attached to one another, the elbow is useful for bending the elbow (and a straw extending through the elbow) at a single angle. When the elbow consists of three or more sections hingedly attached to one another the elbow can be used to bend the elbow (and a straw extending through the elbow) at two or more different angles or make a single angle with a more rounded corner.

Each section of the elbow can be a single piece of material or can comprise two or more than two pieces assembled together to form a single section.

The two sections hingedly attached, and preferably all sections hingedly attached, in the elbow desirably require more force to move with respect to one another about the hinging joint attaching them than the restoring force provided by a dispensing straw about which the elbow resides so that the elbow can retain the straw in a desired bent angle. The force required to cause two sections to hinge with respect to one another can be increased by increasing the friction between the two sections at the hinging joint (for example, increasing how tightly the two sections press against one another at the joint increases the friction between the two sections). Desirably, the sections include detents that serve to hold the two sections in one position with respect to one another until sufficient force is applied or the detent mechanism is otherwise released to enable hinging movement of the sections with respect to one another. Examples of detents include one or more than one protrusion on one section that mates with one or more than one indentation on a second section to which it is hingedly attached.

The two sections, preferably each section of the elbow that is hingedly attached to an adjacent section, has a passageway defined all the way therethrough (that is, defines a passageway all the way therethrough) through which a dispensing straw can extend. The passageway extends through the sections and perpendicular to the hinging joint. Perpendicular to the hinging joint means that when the two sections move about the hinging joint it bends a straw that extends through the passageway of each section. Hence, the passageway extends through and perpendicular to the hinging joint between two sections attached by the hinging joint.

The cross sectional dimensions of the passageway is desirably similar to, or slightly larger than, the cross sectional dimensions of the dispensing straw that the elbow is to reside around. The elbow desirably slips over a dispensing straw and can slide to different locations along the length of the dispensing straw. At the same time, it is desirable for the elbow to fit snuggly enough against the dispensing straw so as to remain in a location along the straw due to friction between the elbow and the dispensing straw. Allowing the elbow to be movable along the length of the dispensing straw provides a user versatility in the dimensions of the sections of the dimension straw on either side of the elbow. Having the passageway through the elbow sized so as to allow frictional retention of the elbow along the dispensing straw provides convenience in positioning the elbow on the dispensing straw.

The elbow can comprise one or more than one screw, fixed protrusion, and/or other adjustable or non-adjustable object that extends into the passageway to increase frictional contact with a dispensing straw extending through the passageway. For example, an elbow can comprise a set screw that can be tightened against a dispensing straw extending through the passageway of the elbow to hold the elbow in place along the dispensing straw and loosened to allow movement of the elbow along the dispensing straw.

Alternatively, the elbow can be affixed to a dispensing straw that extends through the passageway of the elbow. For example, a glue or other adhesive can reside between one or more section of the elbow and a dispensing straw extending through the passageway of the elbow. The adhesive attaches the dispensing straw to the section or sections of the elbow and prevents movement of the elbow along the length of the dispensing straw.

The length of each of the two sections is not limited in the broadest scope of the invention. However practically, the length of each of the two section is desirably at least one times, preferably two times or more, and can be three times or more, four times or more and even five times or more the largest cross sectional dimension of the passageway extending through the section. By being at least one cross sectional dimension in length the section will have adequate leverage on a dispensing straw extending through the passageway of the section to hold the straw and a defined angle. Longer lengths of section are desirable to more accurately position a dispensing straw at a desired angle. At the same time, it is practical for each of the two sections to be half or less of the length of the dispensing straw about which the section resides or shall reside so that the elbow does not extend longer than the dispensing straw. The sections of the elbow can be the same length or different lengths.

For avoidance of doubt, "length" extends in the direction that the passageway extends and the direction that a straw extends through the passageway. Cross sections extend in a plane perpendicular to length.

As exemplary dimensions, each section of the elbow that is hingedly attached to another section independently typically has a length of 6.25 millimeters (mm) or greater, preferably 9.5 mm or greater and can be 12.7 mm or greater, 19 mm or greater and even 25.4 mm or greater while at the same time are typically 80 mm or less, more typically 60 mm or less and can be 50 mm or less, 40 mm or less, 30 mm or less and even 25 mm or less. Similarly, the passageway through the sections of the elbow is typically generally circular in cross sectional shape and typically has a diameter of 10 mm or less, preferably 7.5 mm or less and more preferably 5 mm or less while at the same time is typically one mm or more, preferably 1.5 mm or more, even more preferably 2 mm or more, yet more preferably 3 mm or more, 4 mm or more and even 5 mm or more.

It is desirable for the elbow to have a length along the dispensing straw extending along the straw from the hinge joint on each section of the elbow It is desirable for the elbow to have a length about the hinge joint that does not apply bending pressure to a dispensing straw extending through the elbow when the elbow is used to bend the straw, and/or does not contact the straw in the plane that the hinge bends, in order to reduce a likelihood of excessively restricting or kinking the dispensing straw at the point of the hinge. Sections of an elbow apply bending pressure to a dispensing straw extending through the elbow in order to bend the dispensing straw. See, for example, the elbows in FIGS. 1(*a*) and (*b*) as well as 2(*a*) and 2(*b*) that have an opening proximate to the hinge so that a dispensing straw extending through the passageway of the elbow and the sections of the elbow do not apply bending pressure and do not contact in the plane in which the elbow bends so the dispensing straw is unrestricted around the hinge where it beds. Desirably, the elbow provides a space about the hinge joint of 3 mm or more, preferably 4 mm or more, more preferably 5 mm or more and can 6 mm or more, 8 mm or more, 10 mm or more, 12 mm or more while at the same time is typically 26 mm or less, preferably 20 mm or less, more preferably 15 mm or less, yet more preferably 10 mm or less and can be 8 mm or less, 6 mm or less, even 5 mm or less that does not contact a straw extending through the elbow. This space is between portions of the sections of the elbow that do contact the dispensing straw extending through the elbow in the plane in which the elbow bends and apply bending pressure the straw when bending the straw.

The elbow is for positioning around a dispensing straw. The dispensing straw can be part of the article of the present invention. As previously stated, the elbow can be affixed (for example, adhesively affixed) to the dispensing straw or the elbow can be free to move along the straw and positioned where a user would like. Desirably, the elbow fits sufficiently snuggly around the straw so that it does not move along the straw unless a user applies force to move it along the straw.

The shape of the sections of the elbow is without limit in the broadest scope of the invention. For example, a section can be tube-like in shape with sides all the way around the passageway extending through the section. Alternatively, a section can extend less than all the way around the passageway extending through the section. For example, a section can extend around a first side of the passageway (and straw extending through passageway) but not an opposing second side of the passageway (and straw extending through the passageway).

The dispensing straw is bendable, which means it can be reversibly bent from one shape to another without breaking. The dispensing straw is desirably made of a polymer composition. Typically, the polymer composition is selected from polyethylene, polyvinyl chloride, polypropylene, rubber and copolymers containing these materials. The dispensing straw can consist of the polymer composition or it can further comprise additional materials such as additives and fillers.

The dispensing straw generally has two opposing ends separated by the straw's length. One of the opposing ends is the dispensing end and the other opposing end is the feed end. The feed end desirably attaches directly or indirectly to a valve stem of a container. In that regard, the dispensing end generally includes a connector either integral to the dispensing straw or attached to the dispensing straw that is capable of attaching to the valve stem of a container. The container usually contains pressurized material (for example, polyurethane foam formulation, latex froth foam formulation, or food products such as cheese spread or whipped dairy or non-dairy topping) that is desirably dispensed through the dispensing straw.

When the dispensing straw is attached to a valve stem of a container containing pressurized material, the material is generally dispensed from the container through the valve stem by depressing or tilting the valve stem. Desirably, the dispensing straw comprise a lever extending generally perpendicular to the length of the dispensing straw to facilitate dispensing material through the valve stem and a dispensing straw attached to the valve stem. Typically, the lever extends 30 degrees or more, preferably 45 degrees or more, more preferably 60 degrees or more, more preferably 70 degrees or more, yet more preferably 80 degrees or more and even more preferably 90 degrees or more while at the same time 150 degrees or less, preferably 120 degrees or less, yet more preferably 110 degrees or less, even more preferably 100 degrees or less relative to the dispensing straw length dimension at the point where the lever attaches to the dispensing straw. While holding the container and applying pressure to the lever of the dispensing straw, the dispensing straw tilts or compresses the value stem and releases pressurized material from the container through the value stem and dispensing straw. Releasing the pressure allows the valve stem to reposition to its original position, ceasing the flow of material from the container through the valve stem. The lever can extend off from only one side of the dispensing straw, can extend off two opposing sides of the dispensing straw, or can extend to any extend including all the way around the dispensing straw.

When the dispensing straw is attached to a valve stem of a container, the lever is desirably between the container and the elbow. The lever can be part of the connector or can be separate from the connector. If separate from the connector, the lever is desirably between the connector and elbow.

The dispensing straw can, in addition to a lever or as an alternative to a lever, comprise a finger pad defined on or attached to the straw. A finger pad is useful for pressing against to dispense material from a container rather than pulling or pushing a lever.

The dispensing straw can also contain features such as a dispensing tip for controlling the flow of material from the dispensing straw during use. For instance, a dispensing tip can narrow the cross sectional area of the passageway through the dispensing straw to increase pressure or can define a shape such as a relatively wide and narrow fan profile to dispense thin and wide bands of material. The dispensing tip can be integral to the dispensing straw or can be a piece attached or affixed to the dispensing straw.

FIGS. 1-5 show embodiments of the present invention to further illustrate aspects of the invention.

Figure 1B:
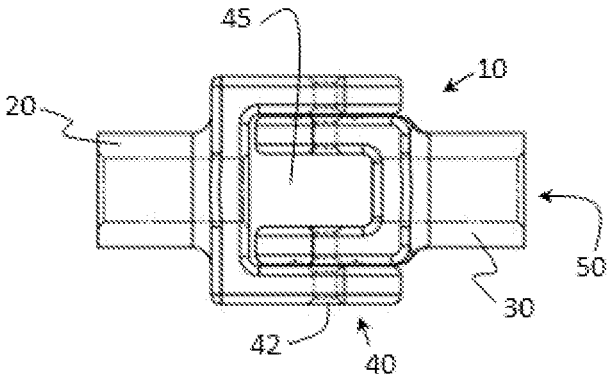

FIGS. 1(*a*) and 1(*b*) illustrate elbow 10 in an angled position and in a top-down perspective, respectively. Elbow 10 has first section 20 and second section 30 hingedly attached to one another by means of hinging joint 40. Hinging joint 40 comprises pins 42 that extend through sections 20 and 30. Pins 42 hold sections 20 and 30 together while allowing sections 20 and 30 to rotate in a plane perpendicular to the line containing the pins. Sections 20 and 30 define passageway 50 that extends through both sections 20 and 30 as well as hinging joint 40. Sections 20 and 30 completely surround passageway 50. Elbow 10 has a length 45 about the hinge joint 40 that does not apply bending pressure to a dispensing straw extending through elbow 10 when elbow 10 is used to bend the straw.

Figure 2A:
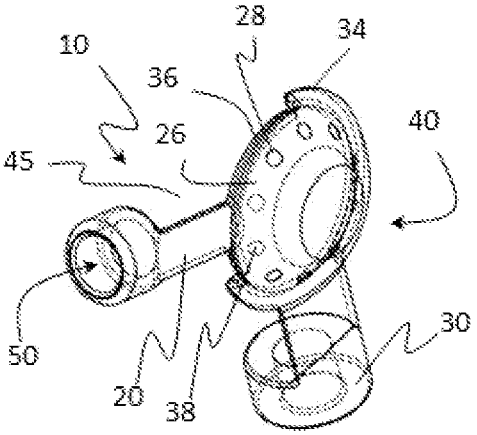
FIG. 2 illustrates an example of an elbow article of the present invention that does not fully enclose the passageway through most of each section
Figure 2B:
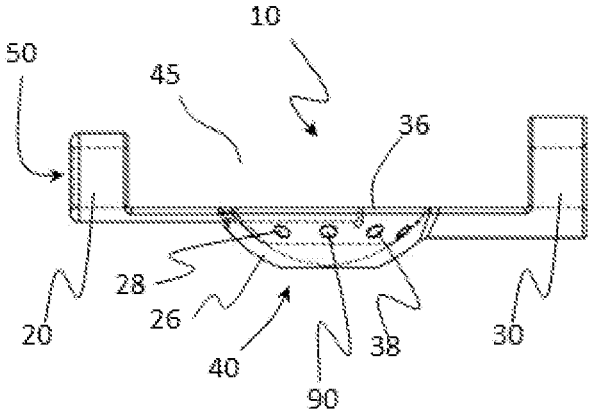

FIGS. 2(*a*) and 2(*b*) illustrate another version of elbow 10 in an angled position and in a top-down perspective, respectively. Elbow 10 has first section 20 and second section 30 hingedly attached to one another by means of hinging joint 40. First section 20 and second section 30 are held together by snapping cupped disk 26 of first section 20 into a groove (not shown) in ring 34 of second section 30 so that cupped disk 26 resides over and mates with cupped disk 36 of second section 30. Alternatively, sections 20 and 30 can be held together with a pin or bolt similar to that illustrated in FIGS. 1(*a*) and 1(*b*). Hinging joint 40 comprises detents 90 in the form of semi-bead-like protrusions 28 on cupped disk 26 of first section 20 that mate with indents 38 on cupped disk 38 of second section 30 to snap the elbow into specific angles when one of sections 20 and 30 is rotated with respect to the other about hinge 40. Sections 20 and 30 define passageway 50 that extends through both sections 20 and 30 as well as hinging joint 40. Elbow 10 has a length 45 about the hinge joint 40 that does not apply bending pressure to a dispensing straw extending through elbow 10 when elbow 10 is used to bend the straw. Length 45 of elbow 10 of FIGS. 2(*a*) and 2(*b*) is longer than length 45 of elbow 10 of FIGS. 1(*a*) and 1(*b*).

Figure 3:
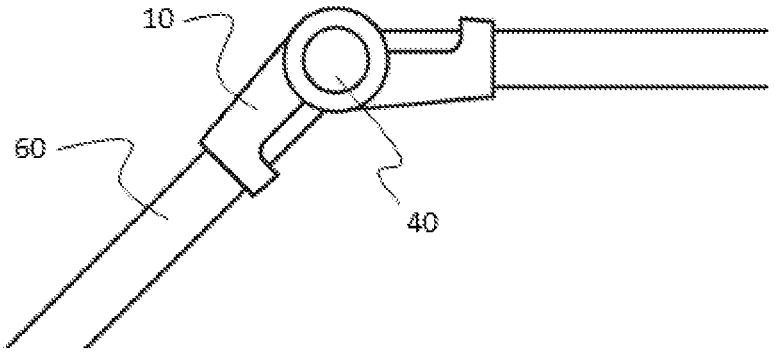
FIG. 3 illustrates the elbow of FIG. 2 in place around a dispensing straw.

FIG. 3 illustrates elbow 10 from FIGS. 2(*a*) and (*b*) with dispensing straw 60 in place through passageway 50. Elbow 10 is holding straw 60 in an angled position.

Figure 4:
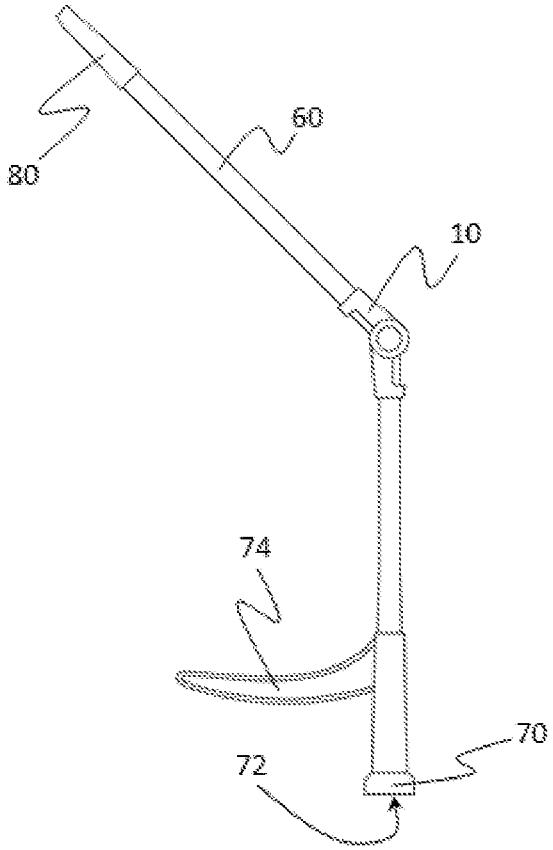
FIG. 4 illustrates a dispensing straw with the elbow of FIG. 2 bending it.

FIG. 4 illustrates elbow 10 from FIGS. 2(*a*) and (*b*) with dispensing straw 60 in place through passageway 50. On one end of straw 60 is connector 70 that enables attachment to a container valve stem via opening 72. Connector 70 also forms lever 74. Dispensing straw 60 further comprises a dispensing tip 80.

Figure 5:
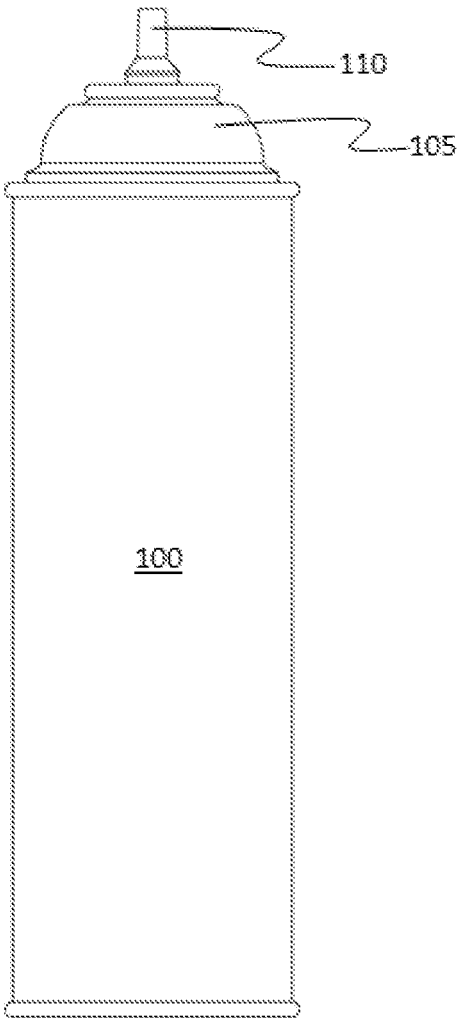
FIG. 5 illustrates a can suitable for attaching a dispensing straw.

FIG. 5 illustrates container 100 with valve stem 110 extending through top 105 of can 100. Connector 70 of straw 60 from FIG. 4 can screw onto valve stem 110 to attach dispensing straw 60 to container 100.

Figure 6:
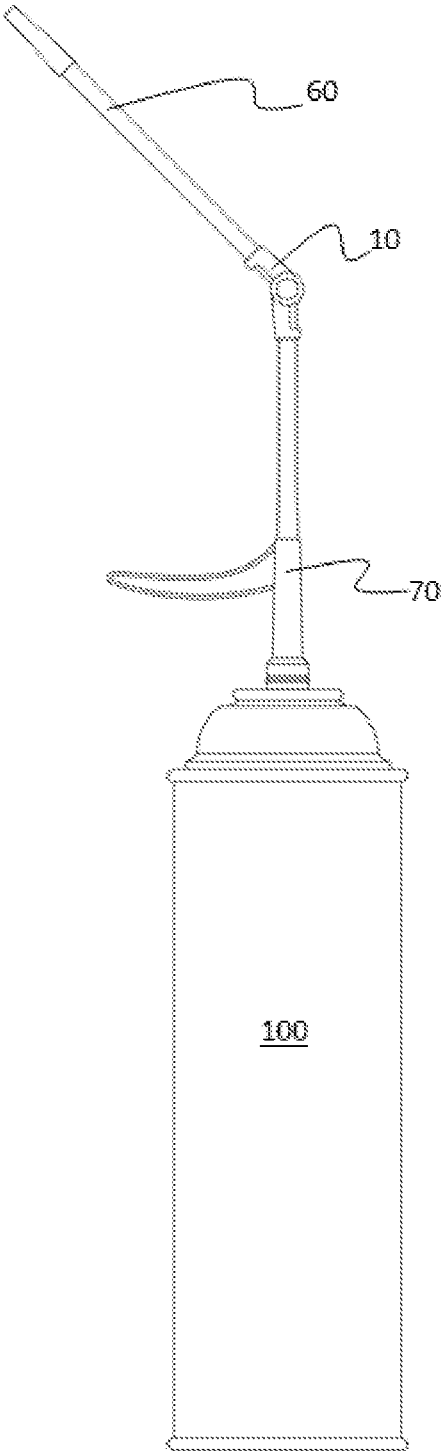
FIG. 6 illustrates an article of the present invention comprising a dispensing straw and the elbow of FIG. 2 with the dispensing straw attached to a container's valve stem via a connector comprising a lever.

FIG. 6 illustrates container 100 from FIG. 5 with connector 70 of straw 60 from FIG. 4 attached to valve stem 110 (not visible). The angle of dispensing straw 60 relative to container 100 can be changed by adjusting the angle of elbow 10.

The invention claimed is:

1. An article comprising an elbow (10) comprising at least two sections that are hingedly attached to one another by means of a hinging joint (40) so that the first section (20) can move in a plane with respect to the second section (30), wherein the sections define a passageway (50) through the elbow through which a dispensing straw (60) can extend where the passageway extends all the way through the two sections and perpendicularly through the hinging joint attaching them and further characterized by the elbow being movable along the length of a dispensing straw to provide versatility in the dimensions of sections of straw on either side of the elbow, the article further comprising a dispensing straw (60) extending through the elbow, wherein the at least two sections of the elbow apply bending pressure to the dispensing straw extending through the elbow in order to bend the dispensing straw, the dispensing straw having two opposing ends, with one of the opposing ends being a feed end and the other opposing end being a dispensing end, the feed end of the dispensing straw being capable of attaching to a valve stem of a container of pressurized material such that the feed end of the dispensing straw and the valve stem have the same axis, wherein the dispensing straw can tilt or compress the value stem to release pressurized material from the container; and the dispensing end of the dispensing straw having a dispensing tip for controlling the flow of material from the dispensing straw.

2. The article of claim 1, wherein the sections comprise detents (90) that inhibit moving one section with respect to the other.

3. The article of claim 1, wherein the dispensing straw comprises a lever (74) extending generally perpendicular to the length of the dispensing straw.

4. The article of claim 3, further comprising a container (100) that has a valve stem (110) through which the contents of the container are able to be dispensed and wherein the dispensing straw has a connector (70) on one end that is capable of attaching to the valve stem and wherein the lever is between the connector and the elbow along the dispensing straw or part of the connector.

5. The article of claim 1, wherein the dispensing straw consists of a bendable polymer composition.

6. The article of claim 1, wherein the elbow has a length about the hinge joint that does not apply bending pressure to a dispensing straw extending through the elbow when the elbow is used to bend the straw.

7. The article of claim 1, wherein the elbow has a length about the hinge joint that does not contact a dispensing straw extending through the elbow when the elbow is used to bend the straw.

8. The article of claim 1, wherein a section of the elbow extends less than all the way around the passageway extending through the section.

9. The article of claim 1, wherein a section of the straw within the elbow is not enclosed by the elbow.

* * * * *